US005518420A

United States Patent [19]

Pitschi

[11] Patent Number: 5,518,420

[45] Date of Patent: May 21, 1996

[54] ELECTRICAL CONNECTOR FOR A CORRUGATED COAXIAL CABLE

[75] Inventor: Franz X. Pitschi, Rottach-Egern, Germany

[73] Assignee: Spinner GmbH Elektrotechnische Fabrik, München, Germany

[21] Appl. No.: 251,030

[22] Filed: May 31, 1994

[30] Foreign Application Priority Data

Jun. 1, 1993 [DE] Germany ..... 43 18 176.7

[51] Int. Cl.[6] ..... H01R 9/07

[52] U.S. Cl. ..... 439/578; 439/825

[58] Field of Search ..... 439/578–585, 439/675, 63, 825

[56] References Cited

U.S. PATENT DOCUMENTS 3,291,895 12/1966 Van Dyke ..... 439/578
4,046,451 9/1977 Juds et al. ..... 439/583
5,137,470 8/1992 Doles ..... 439/583
5,167,533 12/1992 Rauwolf ..... 439/583

FOREIGN PATENT DOCUMENTS 4020326 1/1992 Germany ..... 439/583

*Primary Examiner*—David L. Pirlot
*Attorney, Agent, or Firm*—Henry M. Feiereisen

[57] ABSTRACT

A connector for a coaxial cable of a type having a corrugated outer cable conductor and an inner cable conductor includes a housing having a bore formed therein for receiving one end of the coaxial cable. A corrugated nut is attached on the outer conductor and securable to the housing. In order to ensure a secure clamping of the coaxial cable which is only prepared by cutting its end at a right angle to its longitudinal axis, a support ring is centrally positioned in the bore of the housing and has an outer contour which complements the inner contour of the outer conductor.

18 Claims, 8 Drawing Sheets

151d
15d
116

116
151d
III
III
116a
15d 75e
75
5
451
452
65
35
25
145
125
135
115
45
751
752
35b
85a
116
15d
15
200
15a

ELECTRICAL CONNECTOR FOR A CORRUGATED COAXIAL CABLE

BACKGROUND OF THE INVENTION

The present invention refers to an electrical connector for coaxial cables.with helically corrugated outer conductor and smooth or helically corrugated inner conductor.

In general, a connector for attachment to the corrugated outer conductor of a coaxial cable includes a connector housing with a bore formed therein for receiving a cable end, and a corrugated nut which is threaded on the outer cable conductor and securely tightened to the connector housing to establish a contact. The connection of the central inner connector conductor with a tubular inner corrugated cable conductor can be created via a central screw fastener which engages a plug received in the end section of the inner cable conductor and having an outer circumference substantially complementing the helical corrugation of the inner cable conductor Connectors are known, e.g. from U.S. Pat. No. 3,291,895, in which the corrugated outer conductor of the coaxial cable is solely contacted with the connector housing by pressing the end face of the outer conductor against an annular surface in the bore of the connector housing when tightening the corrugated nut for engagement with the connector housing. Since materials used for the outer cable conductor include primarily copper alloys or aluminum alloys which tend to a plastic deformation in particular when subjecting the cable to mechanical stress, this type of contact making will progressively deteriorate and impair the quality of contact making in particular when large armatures are concerned.

For this reason, connectors have long been used which are designed in such a manner that the outer cable conductor is provided with a front edge which is flanged outwardly at a right angle or at least flared and securely clamped between respective ring surfaces or conical surfaces in the connector housing. One clamping surface may be formed on a tension ring in the connector housing or in a bore thereof while the other clamping surface may be provided directly on the corrugated nut or on a separate compressor. The clamping action can be accomplished by securing the corrugated nut to the connector housing. Alternatively, the clamping action may be created through provision of a separate clamping or receiving sleeve which acts upon the corrugated nut and is screwed to the connector housing or secured via screw fasteners. Connectors of this type are disclosed e.g. in German publications DE-OS 21 27 927, DE-OS 35 22 736 and DE-OS 42 02 813. Despite realizing good to very good electric properties, the assembly of such connectors is very complicated, in particular when considering the required flaning through special flooring machines and subsequent aligning of the outer conductor end.

European Pat. No. EP 0 517 034 A2 discloses a connector in which the inner connector conductor is essentially of two-part construction, with one part being securely supported by a conventional insulator and including in direction of the cable a sleeve with several axial slots. The other part of the inner connector conductor includes the central screw fastener with a cylindrical head which is overlapped by the slotted sleeve of the one part of the inner connector conductor after assembly. The attachment of the connector to the coaxial cable requires a suitable preparation of the coaxial cable end for allowing a complete insertion of the plug into the inner cable conductor. Subsequently, the central screw fastener is threaded into the plug until a collar provided on the screw fastener between the shank and the head is securely clamped against the end face of the inner cable conductor, with the collar of the screw fastener including two key areas. A connector of this type has the drawback that on the one hand the plug must be threaded into the inner cable conductor and on the other hand after being attached must be secured non-rotatably in order to avoid a subsequent turning when the central screw fastener is screwed in. Only after this preassembly can the connector housing, generally a plug-type connector head, be mounted to the end of the coaxial cable.

SUMMARY OF THE INVENTION

It is an object of the present invention to provide an improved electrical connector obviating the aforestated drawbacks.

In particular it is an object of the present invention to provide an improved electrical connector which can be mounted to a cable previously prepared merely by cutting its end at a right angle to its axis, without requiring a flanging of the outer cable conductor while yet achieving a same electrical quality and mechanical reliability.

It is a further object of the present invention to provide an improved electrical connector with a one-piece inner conductor and which does not require a pre-assembly to the inner cable conductor before the connector housing is mounted to the cable end.

These objects and others which will become apparent hereinafter are attained in accordance with the present invention by arranging centrally in the bore of the connector housing a support ring which has an outer contour essentially following the inner contour of the outer cable conductor.

In accordance with the present invention, the corrugated outer cable conductor is secured in the connector housing by an inner support ring which although coacting with the corrugated nut, is situated—in contrast to the corrugated nut—in the internal field between the outer conductor and the inner conductor. In a mechanical sense, especially in the context of assemblage, the provision of such a support ring has numerous advantages as will be explained furtherbelow. However, the inclusion of the support ring leads also to a characteristic impedance variation which causes a slight reflection. This reflection however can be easily compensated. In most cases, the support ring will generate a small capacitive component which can be compensated partly by providing the required conductive component during attachment of the connector to the coaxial cable through a shortening of the dielectric by a distance which substantially equals the axial length of the support ring.

Attachment of the connector according to the invention does not require any special tools. In particular, there is no necessity to flange or flare the end face of the outer cable conductor as conventionally done by hand or at mass production through special bordering machines. By omitting this process step alone, the assembly time is considerably reduced. Moreover, mechanical stress on the outer conductor caused through flanging is eliminated, and connectors according to the invention can be attached to coaxial cables at significant reproducibility of mechanical and electrical properties.

A secure mechanical clamping of the cable to the connector can be established in a most simple way through tightening of the corrugated nut, especially when providing the nut and/or the inner support ring with a slightly conical corrugated thread. The nut and/or the support ring may be axially slotted so as to be resilient in radial direction and slightly compressible.

The support ring should be sufficiently short in axial direction in order to minimize the generated capacitive component of the characteristic impedance and the constructive measures required for compensation. Preferably, the axial length of the support ring should be at least half the pitch and at most twice this pitch of the helical corrugation of the outer conductor.

Suitably, the attachment of the connector is preceded by cutting the coaxial cable end square so that the outer cable conductor and the inner cable conductor terminate in a same radial plane. A still desired, complete compensation of the inductive component can be obtained by shortening the diameter of the inner connector conductor, e.g. by providing the inner connector conductor with a forward part of such diameter and length that the forward pad of the inner connector conductor when plugged into the inner cable conductor projects rearwardly beyond the end face of the inner cable conductor by a distance which is sufficient to compensate reflection generated by the wall thickness of the support ring.

In order to take into account manufacturing tolerances for the corrugation of the outer cable conductor and a required certain axial play when securing the connector to the end of the coaxial cable, it is preferred to provide between the helical corrugation of the nut and the helical corrugation of the support ring a gap which is about twice the maximum wall thickness of the outer cable conductor. A secure connection longitudinally between the connector and the outer cable conductor is attained by providing at the base of the gap between the support ring and the corrugated nut a profiled ring seal which complements in circumferential direction the pattern of the opposing end face of the outer conductor.

A particular simple assembly of the connector according to the invention is accomplished by providing the undulation of the outer cable conductor with a sufficiently small pitch to effectuate a self-locking thread. In this case, the support ring can be fixedly secured, e.g. in one piece, to the connector housing, and the connector housing can be attached to the preassembled unit, comprised of outer cable conductor and corrugated nut with aligned end faces, through threadable engagement until being locked at which point the connector is secured to the outer cable conductor.

According to another feature of the present invention, the support ring is non-rotatably received in the connector housing, with the corrugated nut being screwed in the connector housing until being received non-rotatably but axially displaceable relative to a support ring to allow an attachment of the outer cable conductor, and with the corrugated nut being secured by an axial compressor e.g. a screw sleeve or clamping flange, to the connector housing. A connector of this type does not require a dismantling to enable an engagement on the end of the coaxial cable so that the assembly of the connector to the coaxial cable, in particular on exposed job sites such as antenna poles and the like can be carried out at considerable time saving and increase in safety. The assembly merely requires a removal of the cable sheath and possibly an extraction of the cable dielectric, shortening by a certain distance and reinsertion of the dielectric in the cable. Thereafter, the connector with loosely secured annular flange can be threaded on the outer cable conductor until locking. After securement of the annular flange to the connector housing, the assembly is complete. Certainly, in order to attach the connector to the coaxial cable in this manner, the inner connector conductor and the inner cable conductor must be designed such that they automatically connect to each other, e.g. in form of a plug/socket connection, or the connection therebetween can be attained from the cable-distant end of the connector for which solutions are generally known.

A clamping and contact making of the outer cable conductor is also possible through a collet-type design of the corrugated nut.

The corrugated nut may be connected in one piece or fixedly secured with the connector housing, with the support ring received non-rotatably but axially displaceable in the connector housing. The provision of the corrugated nut may also be omitted altogether when fixedly securing the support ring to the connector housing. This requires however a self-locking action of the helical corrugation of the outer cable conductor, or additional mechanical means for clamping the cable e.g. through a shrunk-on hose connection between the connector and the cable sheath.

As set forth above, the present invention also refers to a connector for coaxial cables for engagement to a tubular, corrugated inner conductor via a central screw fastener which engages a plug received in the end section of the inner cable conductor and having an outer circumference substantially complementing the undulation of the inner cable conductor.

In order to avoid a pre-assembly of the connector to the inner cable conductor, in accordance with another feature of the present invention, the inner connector conductor is extended in direction toward the cable by a socket which has an inner contour substantially complementing the outer contour of the helically corrugated inner cable conductor, with the plug being loosely but nonorotatably received in the socket and with the head of the central screw fastener being accessible from the connector side and fully traversing the inner connector conductor.

In this manner, without additional pads for making the inner conductor connection and without any special tools, the connector can be mounted completely preassembled to the cable end, with the central screw fastener being loosely threaded on the plug. The attachment is simply attained by threading the connector on the cable end until striking a stop point, at which point the non-rotatably retained plug is received in the inner cable conductor, with the end section of the inner cable connector being positioned at this point in the annular gap which is helically corrugated in correspondence to the inner cable conductor and formed between the plug and the socket of the inner connector conductor. After reaching the locking position, it is only required to securely tighten the central screw fastener.

Tubular corrugated inner conductors of coaxial cables frequently have substantial manufacturing tolerances so that it is advantageous to dimension the gap, formed between the profiled outer circumference of the plug and the inner contour of the socket of the inner connector conductor for receiving the inner cable conductor, by about twice the wall thickness of the inner cable conductor.

Through the provision of the socket of the inner connector conductor, the inner cable conductor is not continued at a same diameter within the inner connector conductor. This diametrical enlargement causes a change of the characteristic impedance which is partly compensated already through removal of dielectric approximately by the axial length of the socket of the inner connector conductor. Still, the axial length of the socket should not be unnecessarily large. Suitably, the socket of the inner connector conductor has an axial length which is at least half and at most twice the pitch of the helical corrugation of the inner cable conductor. The remaining change of the characteristic impedance becomes unnoticeable until far into the short wave range. Thus, the outer cable conductor and the inner cable conductor may therefore terminate in a same radial plane.

If its is desired to fully compensate the remaining change of the characteristic impedance, e.g. when using connectors for extreme high frequency ranges and/or with a particular small reflection coefficient, the outer cable conductor is set back relative to the inner cable conductor by about the axial length of the socket of the inner connector conductor, with the axial length of the connector housing correspondingly prolonged and the diameter of the bore of the connector housing increased over the axial length of the socket to obtain also in this area the nominal characteristic impedance. Since the diametrical enlargement through the socket of the inner connector conductor acts capacitively, a compensation conforming to the L-C principle or L-C-L principle may be provided alternatively or if necessary additionally.

There are several possibilities to secure the plug loosely but non-rotatably within the socket of the inner connector conductor. However, it must be ensured that the complementary profiles of the outer plug circumference and the inner socket contour mate each other such that both pads can be threaded together and without jamming on the inner cable conductor. A simple solution includes the provision of a flattening, a short axial groove or the like on the plug in the area of the connector-proximate end of its circumference and the provision of a radial indentation or notch on the socket for engagement in the flattening or axial groove of the plug after threading the plug on the socket and suitable alignment of these pads in circumferential direction. In this manner, the plug is guided for axial displacement to promote a secure clamping of the inner connector conductor with the inner cable conductor when tightening the central screw fastener.

By providing the outer connector conductor and the inner connector conductor in accordance with the present invention and with same pitch of the helical corrugation, the connector can be completely preassembled and attached to the coaxial cable.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
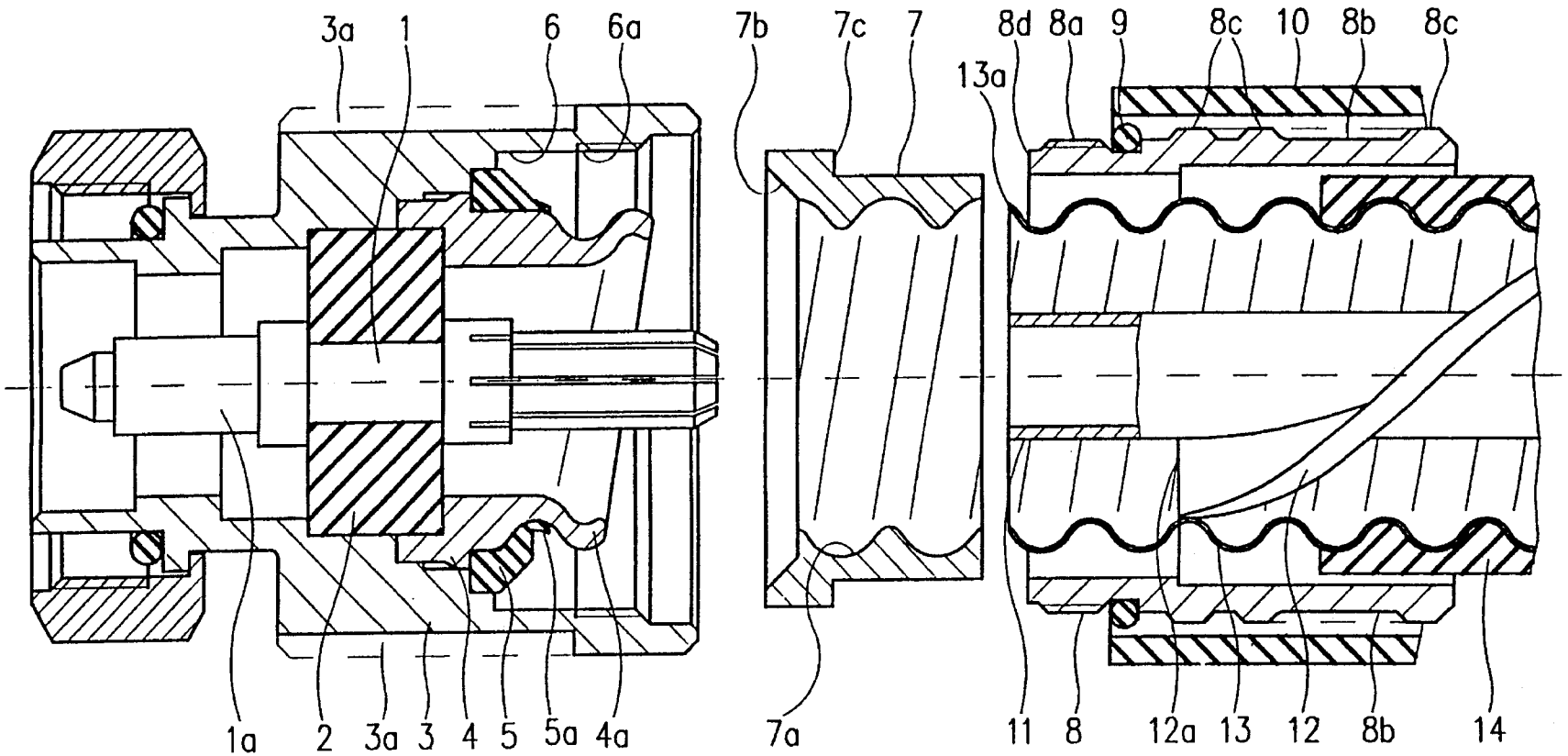
FIG. 1 is an exploded sectional view of a first embodiment of an electrical connector according to the present invention, before assembly on a coaxial cable.

Turning now to the drawing, and in particular to FIG. 1, there is shown an exploded sectional view of the first embodiment of a connector according to the invention, including an inner connector conductor 1 which is centered within a connector housing 3 and supported by an insulator 2. The housing 3 is provided with external key areas 3*a* and defines a stepped bore 6. Received in the bore 6 are an inner support ring 4 which is pressfitted into a rearward section between the housing 3 and the insulator 2, and a profiled ring seal 5 which is sandwiched between the housing 3 and the support ring 4.

Illustrated in FIG. 1 to the right of the housing 3 is a corrugated nut 7, and to the right of the corrugated nut 7 is a threaded sleeve 8 which has an external thread 8*a* engageable with an internal thread 6*a* in the front end of the bore 6. An O-ring 9 is arranged immediately adjacent to the external thread 8*a* of the sleeve 8 which is enclosed by a hose 10 of shrinkable plastic material. In the illustration of FIG. 1, the hose 10 is not yet shrunk on the sleeve 8.

Received in the sleeve 8 is a prepared coaxial cable which includes a smooth inner tubular conductor 11 separated from an outer cable conductor 13 by a dielectric 12 in form of a plastic coil of very large pitch. The outer cable conductor 13 is helically corrugated and surrounded by a sheath 14 which is already cut back i.e. removed by about ⅔ of the length of the sleeve 8 relative to the connector-proximate cable end which is cut at a right angle to the longitudinal axis of the coaxial cable. The sleeve 8 is provided with key areas 8*b* for attachment of an open-end wrench before placement of the shrinkable hose 10 which after being shrunk on is secured to the sleeve 8 by several external annular projections 8*c*.

The support ring 4 has a circumferential section 4*a* with an outer contour which essentially forms a mating surface with the inner contour of the helically corrugated outer cable conductor 13. In the non-limiting example of FIG. 1, the axial length of the section 4*a* is approximately equal to the pitch of the undulation of the outer cable conductor 13. When mounting the connector to the coaxial cable, the support ring 4 is situated with its section 4*a* in the internal field between the inner conductor 11 and the outer conductor 13 of the coaxial cable, so that it is suitable to complement the inner contour of the support ring 4 in the section 4*a* with its outer contour to thereby provide the support ring 4 with an approximately constant wall thickness and to avoid that the distance to the inner cable conductor is reduced to not more than is necessary to attain the required mechanical strength of the support ring 4. After assembly of the connector, the support ring 4 generates in the end area of the coaxial cable a characteristic impedance variation. In this area without further measures the characteristic impedance would be of slightly lower impedance. A partial compensation of the characteristic impedance variation is established already by shortening the dielectric 12 by a length corresponding to the axial penetration of the support ring 4. The shortening of the dielectric 12 is indicated by terminal front edge designated by reference numeral 12*a*. A further and full compensation of the characteristic impedance variation is attained by providing the inner connector conductor 1 with a section of reduced diameter, as will be described in more detail with reference to FIG. 2.

At its cable-distant end, the inner connector conductor 1 is provided with elements including a plug pin 1*a* which are of conventional design and thus are not described in more detail and they do not form part of the present invention.

The corrugated nut 7 is of conventional design and is internally threaded to have an inner contour 7*a* which forms a mating thread with the helically corrugated outer cable conductor 13. At the side facing the connector housing 3, the corrugated nut 7 has a conical ring area 7*b* by which the elastic profiled ring seal 5 is compressed axially when assembling the connector. The profiled ring seal 5 is provided at its end facing the sleeve 8 with a lip-like front edge 5*a* which is undulated in circumferential direction in correspondence to the helically corrugated front edge of the outer cable conductor 13.

Figure 10:
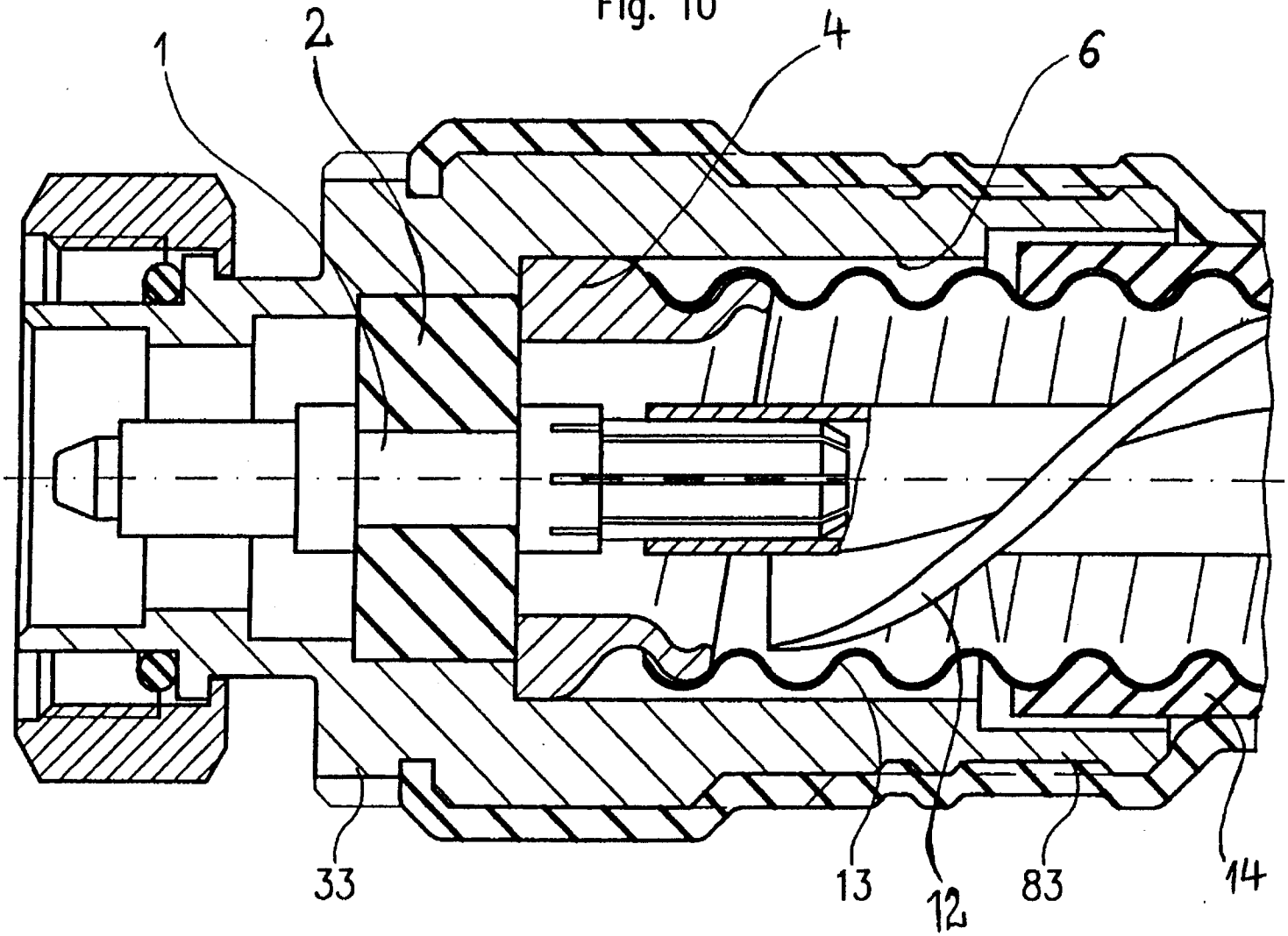
FIG. 10 is a sectional view of a simplified first embodiment of the connector, with the conductors of the coaxial cable end being attached thereto.

In cables with very stiff outer conductor and helical corrugation of sufficiently small pitch to establish a self-lock mechanism, the corrugated nut 7 may be omitted as long as the support ring 4 is non-rotatably secured to the connector housing 3, e.g. through snug fit of the support ring 4 in the connector housing 3, as schematically shown by way of example in FIG. 10.

The electrical connector according to FIG. 1 is preferably attached to the suitably prepared coaxial cable in a following manner:

Initially, the threaded sleeve 8 is placed over the cable and then, the corrugated nut 7 is threaded on the outer cable conductor 13 until the free front end of the outer cable conductor 13 and the left-handed front face of the corrugated nut 7 are aligned and approximately flush. The connector housing 3 in which the support ring 4 is fixedly secured is then threaded on the outer cable conductor 13 until being locked by the abutment of the front edge 13*a* of the outer cable conductor 13 upon the front edge 5*a* of the profiled ring seal 5. At the same time, the corrugated nut 7 is received in the bore 6 of the connector housing 3, essentially in its final position. By engagement of the key areas 3*a* with a not shown open-end wrench, the connector housing 3 is held stationary, and the sleeve 8 engages with its external thread 8*a* the internal thread 6*a* of the bore 6 of the connector housing 3 so that the front edge 8*d* of the sleeve 8 abuts an annular shoulder 7*c* on the outer circumference of the corrugated nut 7. Subsequently, the sleeve 8 is secured through engagement of an open-end wrench in the key areas 8*b* thereby tightening the corrugated nut 7 axially relative to the outer cable conductor 13 which in turn is supported with its inner contour by the outer contour of the support ring 4 along its corrugated section 4*a*. This results in vicinity of the end face of the outer cable conductor 13 in a respective external clamping zone by which a HF-tightness is improved, and an internal contact zone. The clamping and contact zones form a closed ring in axial projection but in actuality follow the helical corrugation of the outer cable conductor 13 and are positioned approximately in the center of the flank of the corrugated profile. Finally, the shrinkable hose 10 is pulled in direction of the connector housing 3 and conventionally shrunk on to end the assembly process. Persons skilled in the art will understand that the provision of the hose 10 is done by way of example only and does not constitute a necessary feature of the present invention.

Figure 2A:
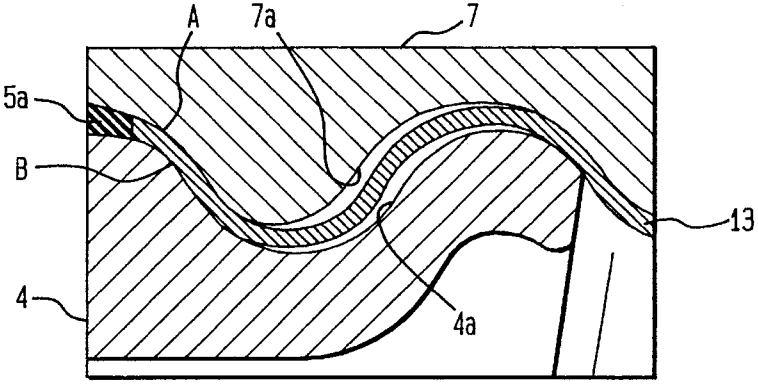
FIG. 2*a* is a detailed illustration, on an enlarged scale, of the connector, in the area X marked in FIG. 2.
Figure 2:
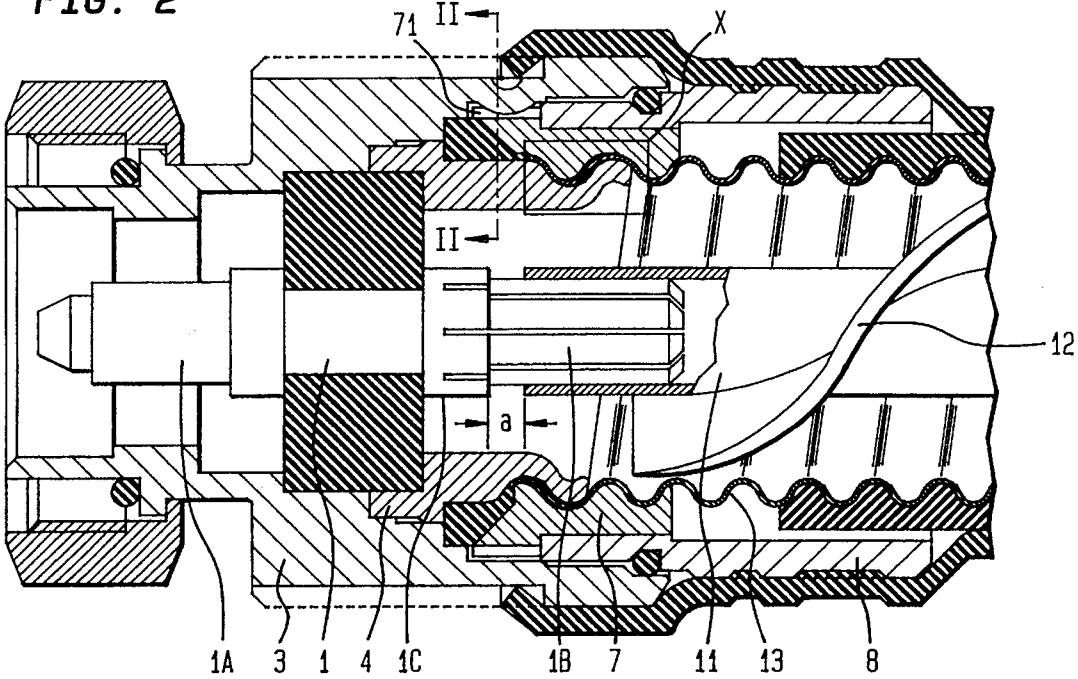
FIG. 2 is a sectional view of a second embodiment of a connector according to the present invention, with the conductors of the coaxial cable end being attached thereto.
Figure 2B:
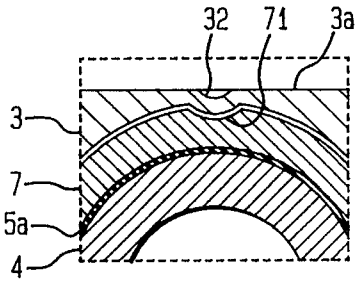
FIG. 2*b* is a fragmentary sectional view of the connector, taken along the line II—II in FIG. 2.

Turning now to FIG. 2, there is shown a sectional view of a second embodiment of a connector according to the invention, with the conductors of the coaxial cable end being attached thereto. The connector of FIG. 2 differs only slightly from the connector of to FIG. 1 but has the significant advantage that the complete connector can be mounted onto the coaxial cable without dismantling. The connector of FIG. 2 is preassembled in such a manner that the corrugated nut 7 is screwed in the bore 6 of the connector housing 3 and, shortly before striking against the base of the bore 6, is aligned relative to the support ring 4 such that a uniform gap 7*a* is formed in circumferential and axial directions between the corrugated nut 7 and the support ring 4 for receiving the outer cable conductor 13 as shown on an enlarged scale in FIG. 2*a*. In this position of the corrugated nut 7 relative to the support ring 4, the corrugated nut 7 is secured against a rotation but is guided for axial displacement. Several constructive possibilities are available for creating such a securement of the corrugated nut 7. A particular simple solution is illustrated in FIG. 2*b* which is a sectional view taken along the line II—II in FIG. 2. As can be seen from FIG. 2*a* the connector housing 3 is provided with a radial indentation 32 which is arranged in the area of one of the key areas 3*a* and of a depth sufficient to engage a flat axial groove 71 on the circumference of the corrugated nut 7 and to complement the inner contour of the indentation 32. With loosely received sleeve 8 and not yet shrunk-on hose 10, the complete connector can be threaded on the suitably prepared end of the coaxial cable shown in FIG. 1 until being locked. Then, while the connector housing 3 is held stationary, the sleeve 8 is tightened as described in connection with FIG. 1 so that the corrugated nut 7 is shifted axially relative to the support ring 4 to a position shown in FIG. 2*a* in which the outer cable conductor 13 is tightly attached to the connector housing 3 and securely electrically contacted in the areas A and B at a same time length the entire contour of the corrugation.

Figures 3, 3A:
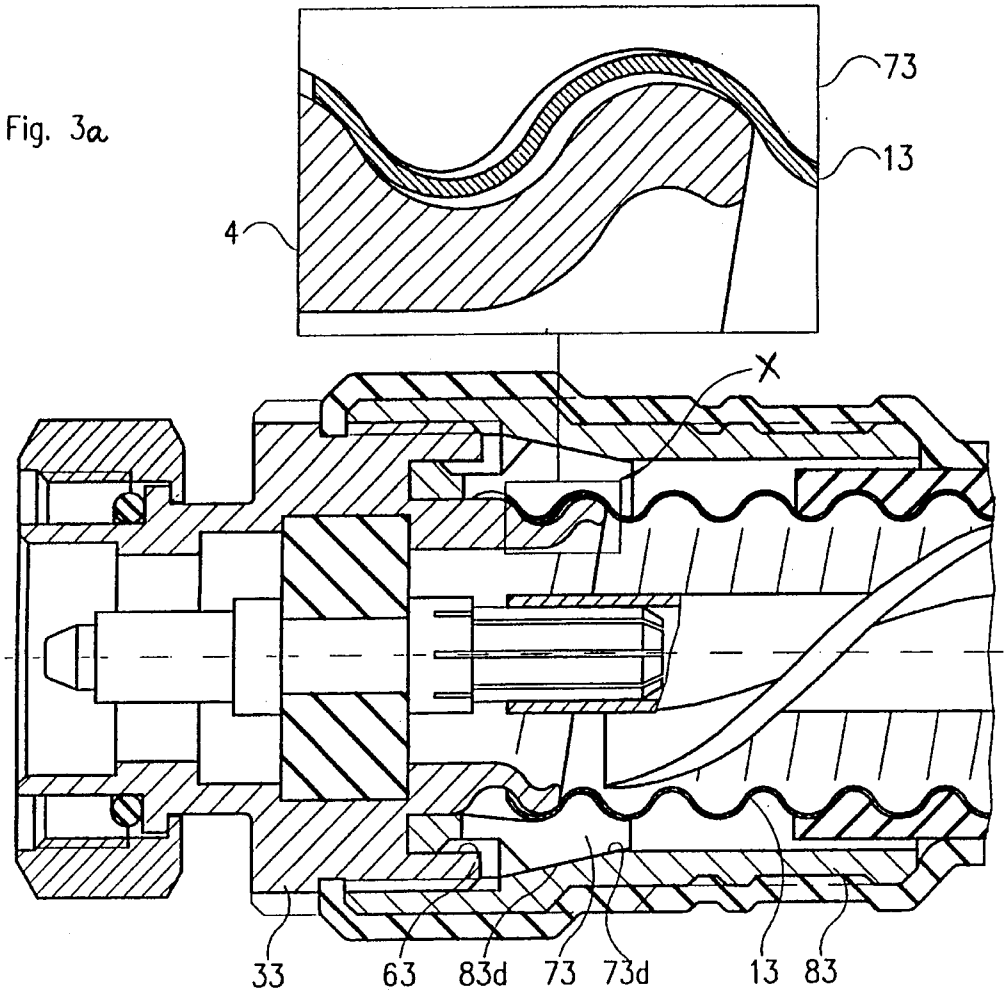
FIG. 3 is a sectional view of a third embodiment of a connector according to the present invention, with the conductors of the coaxial cable end being attached thereto.
FIG. 3*a* is a detailed illustration, on an enlarged scale, of the connector, in the area X marked in FIG. 3

FIG. 2 also clearly shows the connection between the inner connector conductor 1 and the inner cable conductor 11. The inner connector conductor 1 has a forward section 1*b* with an outer diameter which corresponds to the inner diameter of the inner cable conductor 11. The forward section 1*b* is divided into radially elastic segments through provision of axial slots in a manner known per se. As shown in FIG. 2, the section 1*b* extends rearwardly away from the inner cable conductor 11 beyond the front end thereof by a distance a in direction towards the plug pin 1*a* for connection to a section 1*c* which has a diameter of such dimension that the nominal value of the characteristic impedance of the connector at this point is obtained in combination with the inner diameter of the support ring 4. Through the distance a, the forward section 1*b* of the inner connector conductor 1 compensates the reflection caused by the characteristic impedance variation in the area of the support ring 4. By taking the approximate diameter of the section 1*b* of the inner connector conductor 1 into account, the length of the distance a can be selected to result in an optimum compensation of the reflection, FIG. 3 shows a third embodiment of a connector according to the present invention, with the difference to the connector of FIG. I residing in the design of the corrugated nut 73 which is provided with axial slots extending from its cable-proximate end and with a conical circumferential surface 73*d*. The conical circumferential surface 73*d* coacts with a complementary conical circumferential area 83*d* of a threaded sleeve 83 which is threaded over the connector housing 33. In this embodiment in which the corrugated nut 73 serves simultaneously as collet, the connector may be mounted selectively in a manner described in FIG. 1 or FIG. 2. In the latter case, the corrugated nut 73 is securely received in the bore 63 of the connector housing 33 in correct alignment relative to the support ring 4 which is connected in one piece with the connector housing 33. This securement of the corrugated nut 73 can be attained by any suitable means, e.g. through a snug fit, because in this embodiment the electric contacting with and mechanical attachment to the outer cable conductor 13 is obtained through radial compression of the corrugated nut 73 via the coacting conical surfaces 73*d* and 83*d*, rather than through axial displacement.

Figure 4:
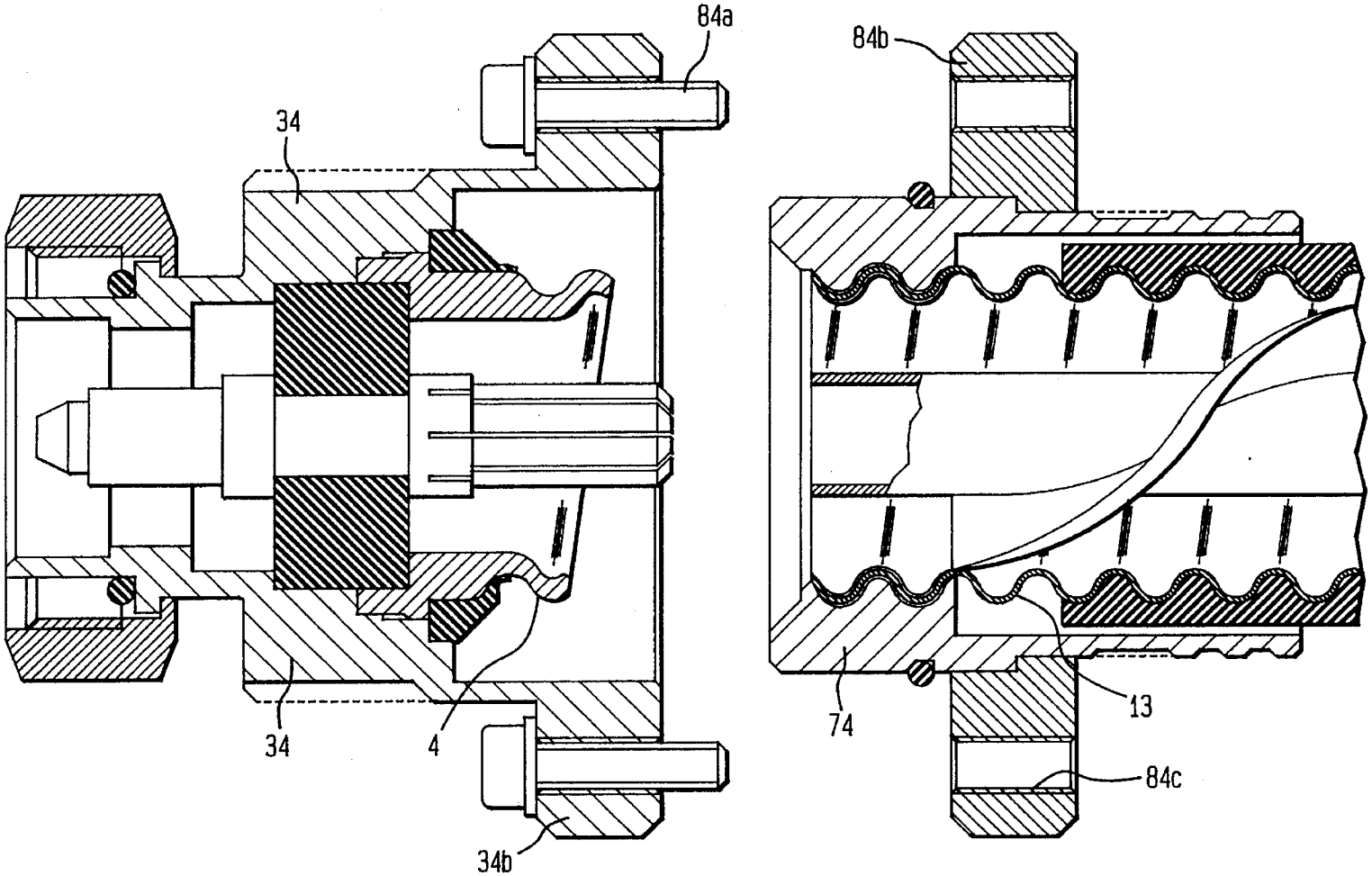
FIG. 4 is an exploded sectional view of a first embodiment of a connector according to the present invention in a partly assembled position.

A fourth embodiment of a connector according to the invention is illustrated in FIG. 4 and corresponds essentially to the embodiment according to FIG. 1 with the difference residing in the manner of attachment of the corrugated nut 74 to the connector housing 34. The cable-facing end of the connector housing 34 is provided in form of e.g. an annular flange 34*b* which is defined with bores therein for traversal of screw fasteners 84*a*. The screw fasteners 84*a* are receivable in threaded bores 84*c* of a flange or tension ring 84*b* which bears upon the outer surface of the corrugated nut 74 in interlocking manner to prevent an axial displacement but to allow a securement in circumferential direction relative to the corrugated nut 74. Suitably, the corrugated nut 74 is extended in form of a clamping flange.

In an analogous manner as described with reference to the connector of FIG. 1, during assembly of the connector, the corrugated nut 74 is held stationary in the illustrated position while the connector housing 34 is threaded with its support ring 4 on the outer cable conductor 13 until being locked. Then, if necessary, the tension ring 84*b* is rotated in circumferential direction for alignment of the threaded bores 84*c* with the screw fasteners 84*a* which are then uniformly tightened to end the assembly. A connector according to this embodiment is suitable in particular for large armatures which cannot be handled with open-end wrenches.

Figures 5, 5A:
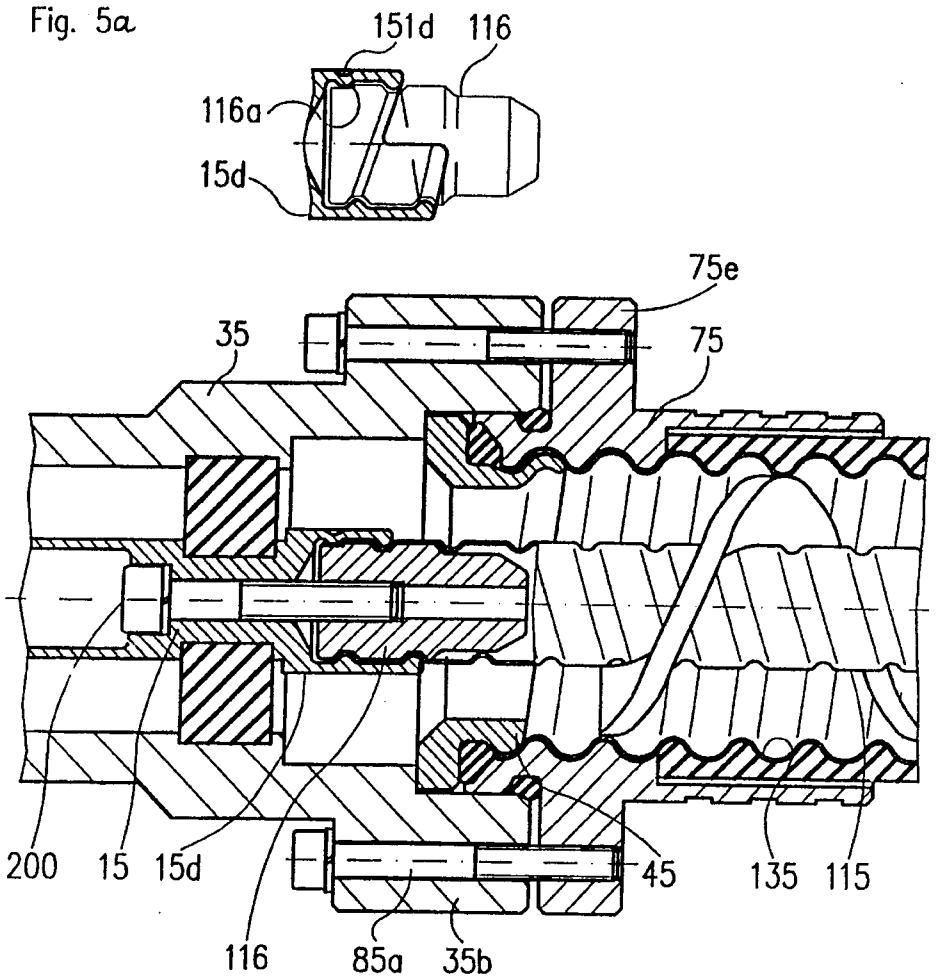
FIG. 5 is a sectional view of a fifth embodiment of a connector according to the present invention, with the conductors of the coaxial cable end being attached thereto.
FIG. 5*a* is a fragmentary, partly sectional view of a detail of the connector of FIG. 5, illustrating the socket of the inner connector conductor with loosely received plug.

The embodiment of the connector according to FIG. 5 differs from the connector of FIG. 4 by providing the corrugated nut 75 in one piece with a clamping flange 75*e*. The connector housing 35 is substantially similar to the connector housing 34 shown in FIG. 4 and has a flange 35*b* traversed by screw fasteners 85*a* for engagement in respective threaded bores in the clamping flange 75*e*. The connector housing 35 surrounds a support ring 45 which is designed as separate structural element.

FIG. 5 additionally illustrates the securement and contact making of the inner connector 15 with an inner cable conductor 115 in form of a helically corrugated tube by applying the same principle as described in FIGS. 1 to 4 in connection with the attachment to the outer cable conductor. In the fully assembled stage of the connector, the inner cable conductor 115 receives at its connector-proximate end a plug 116 which has an outer contour which essentially follows the helical corrugation of the inner cable conductor 115. The plug 116 thus corresponds in a functional sense to the corrugated nut 75. In contrast to the preceding embodiments according to FIGS. 1 to 4, the coaxial cable is now usually cut perpendicular to its longitudinal axis but the outer cable conductor 135 is set back relative to the corrugated inner cable conductor 115 by a distance approximately corresponding to the axial length of the support ring 45. The inner connector conductor 15 is provided at its cable-proximate end with a sleeve-like prolongation forming a socket 15*d*, with an inner contour following substantially the outer contour of the helical corrugation of the inner cable conductor 115, as also shown in detailed illustration of FIG. 5*a*. Thus, the socket 15*d* of the inner connector conductor 15 corresponds in a functional sense to the support ring 45.

For attachment of the connector, the connector housing 35 together with the socket 15*d* of the inner connector conductor 15 is threaded on the inner cable conductor 115 until the outer cable conductor 135 abuts against the profiled ring seal 5 at which point the connector housing 35 overlaps the support ring 45 and partly overlaps the corrugated nut 75. In contrast to the embodiment of FIG. 2, the support ring 45 and the corrugated nut 75 have been previously attached to the outer cable conductor 135. Evidently, the non-rotational securement between the connector housing and the corrugated nut as described with reference to FIG. 2 is now omitted. After being suitably aligned with the bores in the flange 75*e*, the screw fasteners 85*a* are tightened. A turning of the connector housing 35 relative to the corrugated nut 75 to align the screw fasteners 85*a* with the bores in the flange 75*e* is possible because the inner connector conductor 15 is not supported by the insulator 2 in a form-fitting manner so that the connector housing 35 can be turned relative to the inner connector conductor 15. The inner cable conductor 115 and the inner connector conductor 15 are mechanically clamped and electrically contacted with each other by a central screw fastener 200 which engages a thread in the plug 116 by turning the head of the screw fastener 200 from the accessible connector side.

In this type of attachment, the plug 116 is preassembled in the inner cable conductor 115 and non-rotatably secured therein. Of greater advantage is an attachment in which, in analogy to the embodiment of FIG. 2, the plug 116 is initially received non-rotatably but axially shiftable in the socket 15*d* together with the loosely engaged central screw 200. Suitably, as shown in FIG. 5*a*, the socket 15*d* is provided with an indentation 151*d* which engages an axial groove 116*a* on the circumference of the plug 116 so that the socket 15*d* and the plug 116 can be threaded in unison onto the inner cable conductor 115.

Figures 6, 7, 8:
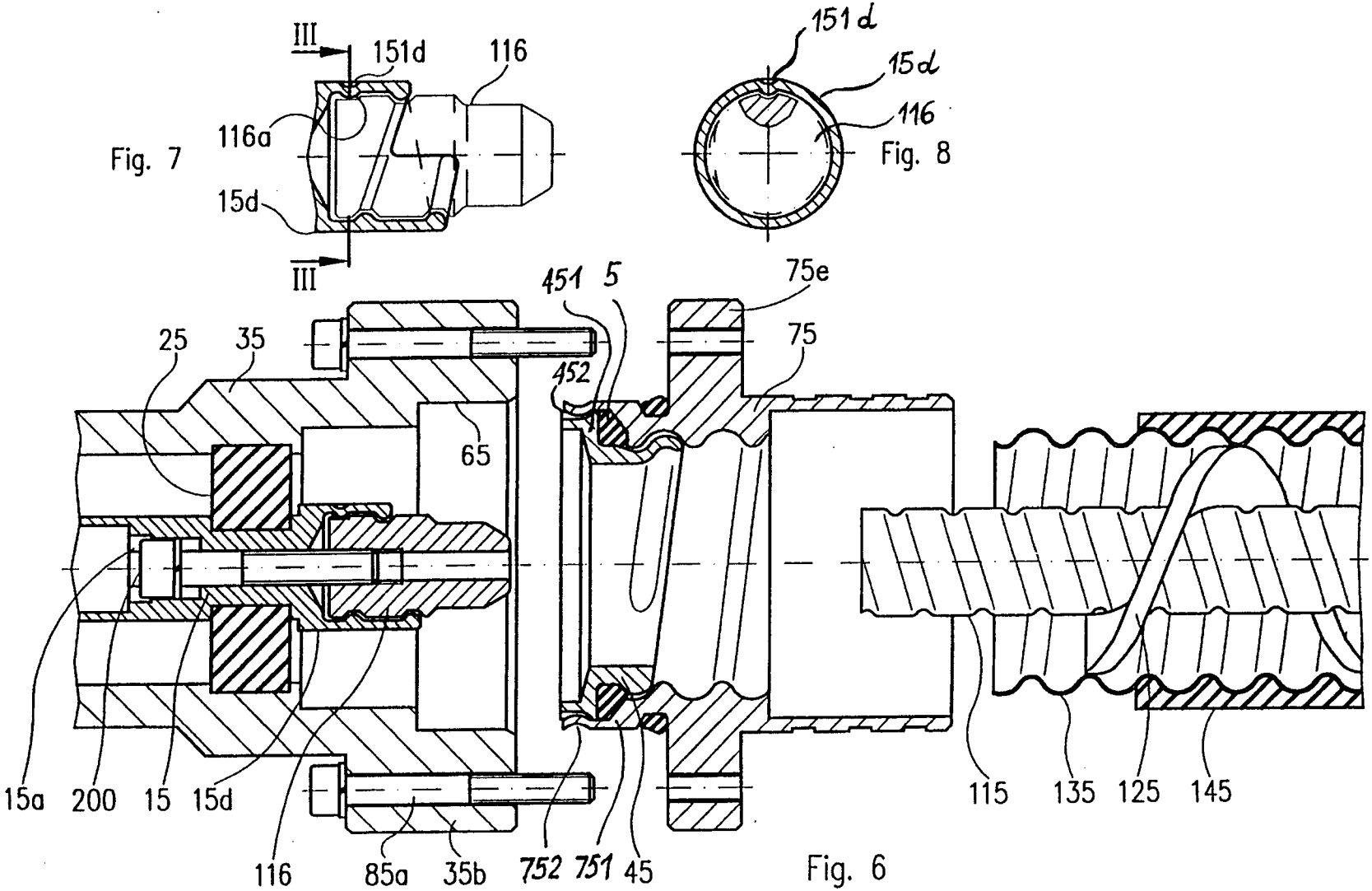
FIG. 6 is an exploded, sectional view of a sixth embodiment of a connector according to the present invention, before assembly on the coaxial cable.
FIG. 7 is a fragmentary, partly sectional view of a detail of the connector of FIG. 6, illustrating the socket of the inner connector conductor with loosely received plug.
FIG. 8 is a cross sectional view taken along the line, III—III in FIG. 7.

FIG. 6 shows a further improved embodiment of the connector according to FIG. 5 before being attached to the coaxial cable. The inner connector conductor 15 is supported within the connector housing 35 by an insulator 25, with the housing 35 being defined with a stepped bore 65 therein. To the right of the housing 35 is the support ring 45 for the outer conductor 135 and the corrugated nut 75 with flange 75*e* for engagement with the flange 35*b* of the housing 35 via the screw fasteners 85*a*.

At its connector-proximate end, the support ring 45 is provided with a cylindrical section 451 which is provided on two diametrically opposed areas with a shod axial groove 452 in the circumference of the section 451. Engaging the grooves 452 are radial indentations 752 which are formed on the corrugated nut 75 along a cylindrical, thin-walled prolongation 751 which overlaps the section 451 of the support ring 45. In this manner, the support ring 45 as well as the profiled ring seal 5 are captivated in non-rotational manner but slightly axially displaceable in the corrugated nut 75.

To the right of the corrugated nut 75 is the coaxial cable with tubular corrugated inner conductor 115 which is spaced from the corrugated outer conductor 135 by a dielectric in form of a coiled insulation 125, and cable sheath 145.

At its cable-proximate end, the inner connector conductor 15 is provided with the socket 15*d* adjoining the support insulator 25 and is traversed by the central screw fastener 200, the head of which is accessible from the cable-distant side of the connector, i.e. from the left hand side in the illustration of FIG. 6, so that the central screw 200 is turnable e.g. by means of an Allen wrench. The central screw 200 is loosely threaded with its shank in a central thread of the plug 116 which itself is loosely received in the socket 15*d* of the inner connector conductor 15.

As shown more clearly in FIG. 7, the plug 116 has an outer circumference which complements the helical corrugation of the inner cable conductor 115, and the socket 15*d* has an inner contour which substantially follows the outer contour of the helical corrugation of the inner cable conductor 115.

In the illustrated preassembly stage of the connector, the plug 116 is non-rotatably received in the socket 15*d*, with the outer plug contour aligned with the inner socket contour and with the indentation 151*d* of the socket 15*d* engaging the axial groove 116*a* of the plug 116, as shown in FIG. 8. In this manner, the plug 116 is loosely and slightly axially displaceable but non-rotatably secured in the socket 15*d*.

Figure 9:
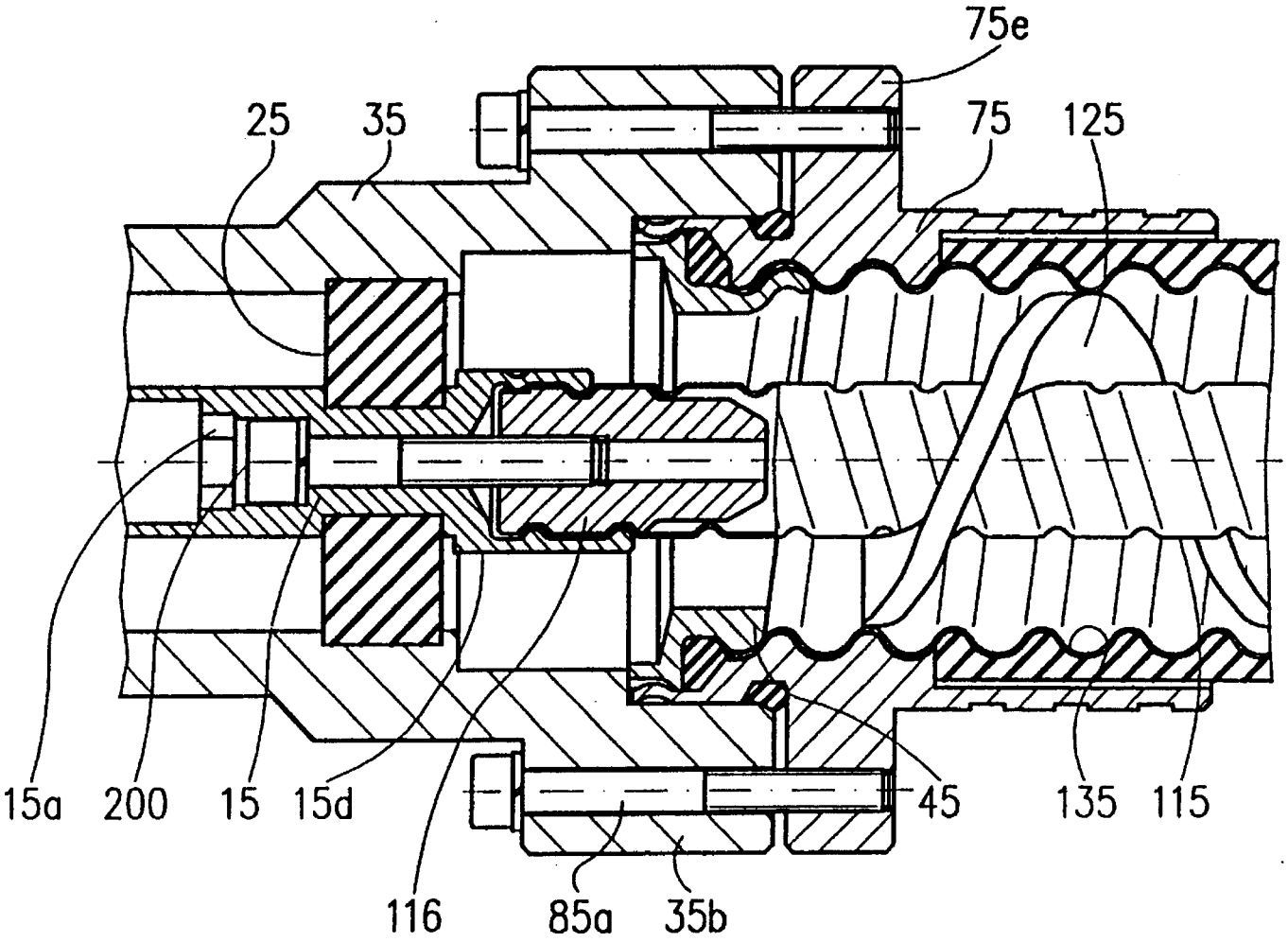
FIG. 9 is a sectional view of the connector of FIG. 6, with the conductors of the coaxial cable end being attached thereto.

For attachment of the connector, the connector housing 35 with the socket 15*d* of the inner connector conductor 15 is threaded on the inner cable conductor 115 until the outer cable conductor 135 abuts the profiled ring seal 5, at which point the connector housing 35 overlaps the support ring 45 and partly overlaps the corrugated nut 75. Both, the support ring 45 and the corrugated nut 75 are previously attached to the outer cable conductor 135. After suitably aligning the flange 35*b* of the connector housing 35 with the flange 75*e* of the corrugated nut 75, the screw fasteners 85*a* are threaded into the bores in the flange 75*e* and tightened to securely clamp the outer cable conductor 135 between the support ring 45 and the corrugated nut 75. The preceding alignment of the connector housing 35 relative to the corrugated nut 75 is possible because the inner connector conductor 15 is supported by the insulator 25 not in form-fitting manner so that the connector housing 35 can turn relative to the inner connector conductor 15. Through tightening of the central screw 200, the inner cable conductor 115 is mechanically received, i.e. clamped via the plug 116 and socket 15*d* and securely electrically contacted. This terminates the assembly apart from other possible sealing measures or the like, as shown in FIG. 9.

This embodiment is advantageous especially in applications with cables with approximately equal pitches of the outer and inner conductors because the connector can be completely preassembled and mounted on the suitably prepared cable end, i.e. without preceding dismantling. In some cases, it may be necessary to turn the inner connector conductor 15 by a box wrench which engages complementary key areas 15*a* (FIG. 9) to such a degree that the plug 116 and the corrugated nut 75 enter the respective helical corrugation of the inner cable conductor and the outer cable conductor. If necessary, the inner connector conductor 15 is turned simultaneously with the connector housing 35 by the wrench during attachment of the connector housing 35.

Even in cables with very different pitches between outer and inner conductors, this preferred mode of assembly can be carried out through continuous relative turning of the inner connector conductor.

While the invention has been illustrated and described as embodied in an electrical connector for a corrugated coaxial cable, it is not intended to be limited to the details shown since various modifications and structural changes may be made without departing in any way from the spirit of the present invention.

What is claimed as new and desired to be protected by Letters Patent is set forth in the appended claims:

1. A connector for a coaxial cable of a type having a helical outer cable conductor and inner cable conductor, comprising:

a housing having a bore formed therein for receiving one end of the coaxial cable;

a clamping member attached to the outer cable conductor and securable to said housing; and a support ring centrally received in said bore of said housing and having a corrugated threaded segment which substantially matches an inner corrugated surface of the outer cable conductor.

2. The connector of claim 1 wherein said support ring has an axial length which is at least half and at most twice the pitch of the helical corrugation of the outer cable conductor.

3. The connector of claim 1 wherein the outer cable conductor and the inner cable conductor terminate in a same radial plane.

4. The connector of claim 1, further comprising an inner connector conductor supported in said housing and having a forward part for attachment to the inner cable conductor, said forward part having a section projecting rearwardly from a front end of the inner cable conductor by a diameter and length dimensioned to compensate reflection generated by the wall thickness of said support ring.

5. The connector of claim 1 wherein said outer cable conductor and said clamping member form a pre-assembled unit with their end faces extending flush, said support ring being securely fixed to said housing to prevent a relative rotation therebetween, said housing being threadable on the pre-assembled until being locked for attachment to the outer cable conductor.

6. The connector of claim 1, further comprising an axial compressor acting upon said clamping member for tightening said clamping member relative to said housing, said clamping member and said support ring being nonrotatably secured in said housing, with said clamping member having a radially resilient collet-type section coacting with said compressor.

7. The connector of claim 1 wherein said clamping member is connected in one piece with said housing, said support ring being received in the housing non-rotatably and axially displaceable for permitting a secure attachment.

8. The connector of claim 1 wherein said support ring is securely fixed to said housing.

9. The connector of claim 1 wherein said clamping member is a corrugated nut.

10. The connector of claim 1 wherein said clamping member is spaced from said support ring to define a gap which is about twice a maximum wall thickness of the outer cable conductor.

11. The connector of claim 10, further comprising a profiled ring seal having a front edge situated at one axial end of said gap in opposition to an end face of the outer cable conductor, said front edge of said profiled ring seal forming a mating surface in circumferential direction with the end face of the outer cable conductor.

12. The connector of claim 1 wherein said support ring is securely fixed to said housing to prevent a relative rotation therebetween, said clamping member being threadable into said housing essentially until being locked and being positioned relative to said support ring to allow an installation of said outer cable conductor, with said clamping member being received nonrotatably and axially displaceable relative to said support ring to permit a secure attachment of said clamping member to said housing.

13. The connector of claim 12, further comprising an axial compressor acting upon said clamping member for tightening said clamping member relative to said housing.

14. A connector for a coaxial cable of a type having a tubular helically corrugated inner cable conductor and an outer cable conductor, comprising:

a housing having a bore formed therein for receiving one end of the coaxial cable;

an inner connector conductor centered in said bore of said housing and formed with a socket which has an inner contour substantially corresponding to the corrugation of the inner cable conductor; and fastening means for connecting said inner connector conductor with the inner cable conductor, said fastening means including a screw fastener being accessible from outside and longitudinally aligned with said inner connector conductor, and a plug received loosely but non-rotatably in said socket and having an outer circumference substantially complementing the corrugation of the inner cable conductor for engagement in an end section of the inner cable conductor.

15. The connector of claim 14 wherein said socket is spaced from said plug to define a gap therebetween which is about twice a wall thickness of the inner cable conductor.

16. The connector of claim 14 wherein said socket of said inner connector conductor has an axial length which is at least half and at most twice the pitch of the helical corrugation of the inner cable conductor.

17. The connector of claim 14 wherein the outer cable conductor and the inner cable conductor terminate in a same radial plane.

18. The connector of claim 14 wherein said plug is provided on its cable-distant end about its circumference with a short axial groove, said socket of said inner connector conductor being provided in a same radial plane with an indentation for engagement in said groove.

* * * * *